US009121226B2

(12) United States Patent
Mageren et al.

(10) Patent No.: US 9,121,226 B2
(45) Date of Patent: Sep. 1, 2015

(54) HYDRAULIC ACTIVATION OF MECHANICALLY OPERATED BOTTOM HOLE ASSEMBLY TOOL

(71) Applicant: Halliburton Energy Services, Inc., Houston, TX (US)

(72) Inventors: Olivier Mageren, Jette (BE); Khac Nguyen Che, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/369,901

(22) PCT Filed: Jan. 24, 2014

(86) PCT No.: PCT/US2014/012928
§ 371 (c)(1),
(2) Date: Jun. 30, 2014

(87) PCT Pub. No.: WO2014/116934
PCT Pub. Date: Jul. 31, 2014

(65) Prior Publication Data

US 2015/0083497 A1 Mar. 26, 2015

Related U.S. Application Data

(60) Provisional application No. 61/756,617, filed on Jan. 25, 2013.

(51) Int. Cl.
*E21B 10/18* (2006.01)
*E21B 34/14* (2006.01)
(Continued)

(52) U.S. Cl.
CPC . *E21B 7/28* (2013.01); *E21B 10/26* (2013.01); *E21B 10/322* (2013.01);
(Continued)

(58) Field of Classification Search
CPC ..... E21B 10/322; E21B 10/60; E21B 34/14; E21B 10/18; E21B 23/10
See application file for complete search history.

(56) References Cited

U.S. PATENT DOCUMENTS 2,238,998 A 4/1941 Grant
2,922,627 A 1/1960 Kammerer
(Continued)

FOREIGN PATENT DOCUMENTS

BE 101254 12/2000
EP 0301890 7/1988
(Continued)

OTHER PUBLICATIONS

International Search Report and Written Opinion of the International Searching Authority issued in International Application No. PCT/US2014/012928 on May 21, 2014; 14 pages.
(Continued)

*Primary Examiner* — Cathleen Hutchins
(74) *Attorney, Agent, or Firm* — Alan Bryson; Fish & Richardson P.C.

(57) ABSTRACT

A method of hydraulically activating a mechanically operated wellbore tool in a bottom hole assembly includes: holding moveable elements of the wellbore tool in an unactivated position using a shear pin; inserting one or more drop balls into a drilling fluid; and flowing the drilling fluid with the drop balls to a flow orifice located in or below the wellbore tool. The flow orifice is at least partially plugged with the drop balls to restrict fluid flow and correspondingly increases the hydraulic pressure of the drilling fluid. The hydraulic pressure is increased to a point beyond the rating of the shear pin, thereby causing the shear pin to shear and allowing the moveable elements of the tool to move to an activated position.

4 Claims, 9 Drawing Sheets

(51) Int. Cl.

| | |
|---|---|
| ***E21B 7/28*** | (2006.01) |
| ***E21B 10/32*** | (2006.01) |
| ***E21B 21/10*** | (2006.01) |
| ***E21B 10/26*** | (2006.01) |
| ***E21B 10/60*** | (2006.01) |
| ***E21B 34/06*** | (2006.01) |

(52) U.S. Cl.

CPC ..... *E21B 10/325* (2013.01); *E21B 10/60* (2013.01); *E21B 21/10* (2013.01); *E21B 34/063* (2013.01); *E21B 34/14* (2013.01)

(56) References Cited

U.S. PATENT DOCUMENTS

| | | | | |
|---|---|---|---|---|
| 3,087,558 | A * | 4/1963 | Dougherty, Jr | 175/65 |
| 3,552,509 | A | 1/1971 | Brown | |
| 5,060,736 | A | 10/1991 | Neff | |
| 5,139,098 | A | 8/1992 | Blake | |
| 5,168,941 | A | 12/1992 | Krueger et al. | |
| 5,520,255 | A | 5/1996 | Barr et al. | |
| 5,778,992 | A | 7/1998 | Fuller | |
| 6,059,051 | A | 5/2000 | Jewkes et al. | |
| 6,360,831 | B1 | 3/2002 | Akesson et al. | |
| 6,470,977 | B1 | 10/2002 | Chen et al. | |
| 6,848,518 | B2 | 2/2005 | Chen et al. | |
| 7,086,485 | B2 | 8/2006 | Moriarty et al. | |
| 7,334,649 | B2 | 2/2008 | Chen et al. | |
| 7,416,036 | B2 | 8/2008 | Forstner et al. | |
| 7,513,318 | B2 | 4/2009 | Underwood et al. | |
| 7,543,639 | B2 | 6/2009 | Emerson | |
| 7,546,886 | B2 | 6/2009 | Benzie et al. | |
| 7,624,820 | B2 | 12/2009 | Angman et al. | |
| RE41,119 | E * | 2/2010 | Åkesson et al. | 175/269 |
| 7,661,490 | B2 | 2/2010 | Raney | |
| 7,730,974 | B2 | 6/2010 | Minshull | |
| 7,770,664 | B2 | 8/2010 | Laird et al. | |
| 8,113,301 | B2 | 2/2012 | Eriksen | |
| 8,141,657 | B2 | 3/2012 | Hutton | |
| 8,186,457 | B2 | 5/2012 | Boyle | |
| 8,196,669 | B2 | 6/2012 | Kriesels | |
| 2003/0164251 | A1 | 9/2003 | Tulloch | |
| 2004/0099447 | A1 | 5/2004 | Howlett et al. | |
| 2005/0126826 | A1 | 6/2005 | Moriarty et al. | |
| 2007/0095573 | A1 | 5/2007 | Telfer | |
| 2009/0095474 | A1 | 4/2009 | Lesso et al. | |
| 2010/0025116 | A1 | 2/2010 | Hutton | |
| 2010/0282463 | A1 | 11/2010 | Boyle | |
| 2011/0220416 | A1 | 9/2011 | Rives | |
| 2012/0024529 | A1 | 2/2012 | Van Zanten et al. | |
| 2012/0055712 | A1 | 3/2012 | Jeffryes et al. | |

FOREIGN PATENT DOCUMENTS

| | | |
|---|---|---|
| EP | 0594420 | 12/1997 |
| EP | 2692982 | 2/2014 |
| GB | 2319046 | 5/1998 |
| GB | 2356417 | 5/2001 |
| GB | 2399366 | 9/2004 |
| WO | WO 00/031371 | 6/2000 |
| WO | WO 2011/121341 | 10/2011 |

OTHER PUBLICATIONS

International Search Report and Written Opinion of the International Searching Authority issued in International Application No. PCT. US2013/047558 on Sep. 27, 2013; 16 pages.

Halliburton, "Cementing," Received Jan. 22, 2013, 1 page http://www.halliburton.com/public/cem/contents/Case_Histories/web/evc/EVC_4783.asp.

Halliburton, "NBR® Near Bit Reamer," Received Aug. 1, 2012, 2 pages.

Halliburton, "Geo-Pilot® Rotary Steerable System," Received Aug. 1, 2012, 5 pages.

Halliburton, "XR™ Reamer Hole Enlargement" Received Aug. 1, 2012, 2 pages.

Halliburton, UnderReamer (UR™) Tool, H03019, Jun. 2009, 2 pages.

Halliburton, "Foam Wiper Balls," H04927, May 2009, 2 pages.

* cited by examiner

HYDRAULIC ACTIVATION OF MECHANICALLY OPERATED BOTTOM HOLE ASSEMBLY TOOL

CLAIM OF PRIORITY

This application is a US National Stage of International Application No. PCT/US2014/012928, filed on Jan. 24, 2014, which claims priority to U.S. Provisional Application No. 61/756,617, filed on Jan. 25, 2013, incorporated herein by reference.

TECHNICAL FIELD

This specification generally relates to systems for and methods of hydraulic activation of a mechanically operated tool positionable in a bottom hole assembly used in drilling a wellbore.

BACKGROUND

During well drilling operations, a drill string is lowered into a wellbore. In some drilling operations, (e.g. conventional vertical drilling operations) the drill string is rotated. The rotation of the drill string provides rotation to a drill bit coupled to the distal end of a bottom hole assembly ("BHA") that is coupled to the distal end of the drill string. The bottom hole assembly may include stabilizers, reamers, measurement-while-drilling ("MWD") tools, logging-while-drilling ("LWD") tools and other downhole equipment as known in the art. In some drilling operations, (e.g. if the wellbore is deviated from vertical), a downhole mud motor may be disposed in the bottom hole assembly above the drill bit to rotate the bit instead of rotating the drill string to provide rotation to the drill bit.

In some drilling operations, in order to pass through the inside diameter of upper strings of casing already in place in the wellbore, often times the drill bit will be of such a size as to drill a smaller gage hole than may be desired for later operations in the wellbore. It may be desirable to have a larger diameter wellbore to enable running further strings of casing and allowing adequate annulus space between the outside diameter of such subsequent casing strings and the wellbore wall for a good cement sheath. A borehole opener ("reamer") may be included in the drill string to increase the diameter of the ("open") borehole.

Figure 1:
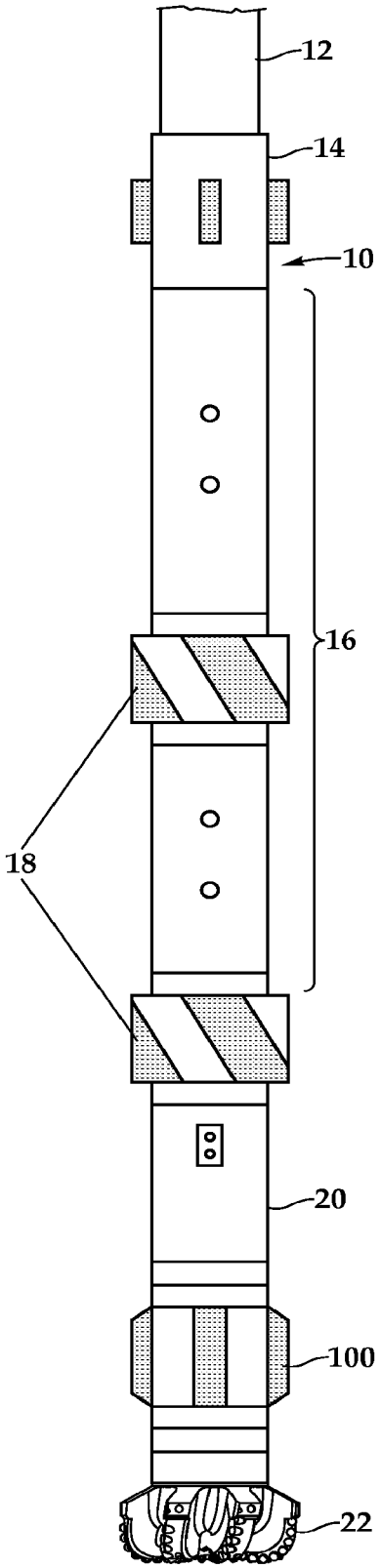
FIG. 1 is a diagram of an example bottom hole assembly featuring a near-bit reamer.

Some of the features in the drawings are enlarged to better show the features, process steps, and results.

DETAILED DESCRIPTION

The present disclosure includes methods and devices for hydraulic activation of a mechanically operated bottom hole assembly tool. In some implementations a near-bit borehole opener/enlargement tool, also known as a near-bit reamer ("NBR"), is disposed on the distal end (or "lower end") of a tool string proximal to the drill bit. For example, the present disclosure relates to devices that may be used to activate cutting blocks of a borehole opener tool by adjusting the hydraulic pressure of the drilling fluid within a bottom hole assembly.

FIG. 1 is a diagram of an example bottom hole assembly 10. The bottom hole assembly 10 is the lower component of a drill string 12 suspended from a drilling rig (not shown). In some implementations, the upper end of the bottom hole assembly 10 includes a conventional under reaming tool 14 (e.g., a Halliburton model XR Reamer or UR-type conventional under reaming tool). Below the conventional under reaming tool 14 is positioned a measurement-while-drilling ("MWD") and/or a logging-while-drilling ("LWD") tool string section 16. The MWD/LWD tool string section 16 is positioned below the conventional under reaming tool 14 so that the enlarged borehole will not degrade performance of the MWD/LWD tools or the associated stabilizer elements 18. Below the MWD/LWD tool string section 16 is a rotary steerable system ("RSS") tool string 20 (e.g., Halliburton's Geo Pilot System) designed to facilitate directional drilling. Similar to the MWD/LWD tool string section 16, the RSS tool string 20 is located below the conventional under reaming tool 14 in order to ensure its proper functioning. The lower end of the bottom hole assembly 10 features an NBR 100 mounted just above the drill bit 22 and below the RSS tool string 20.

In the foregoing description of the bottom hole assembly 10, various items of equipment, such as pipes, valves, fasteners, fittings, articulated or flexible joints, etc., may have been omitted to simplify the description. It will be appreciated that some components described are recited as illustrative for contextual purposes and do not limit the scope of this disclosure.

Figure 2A:
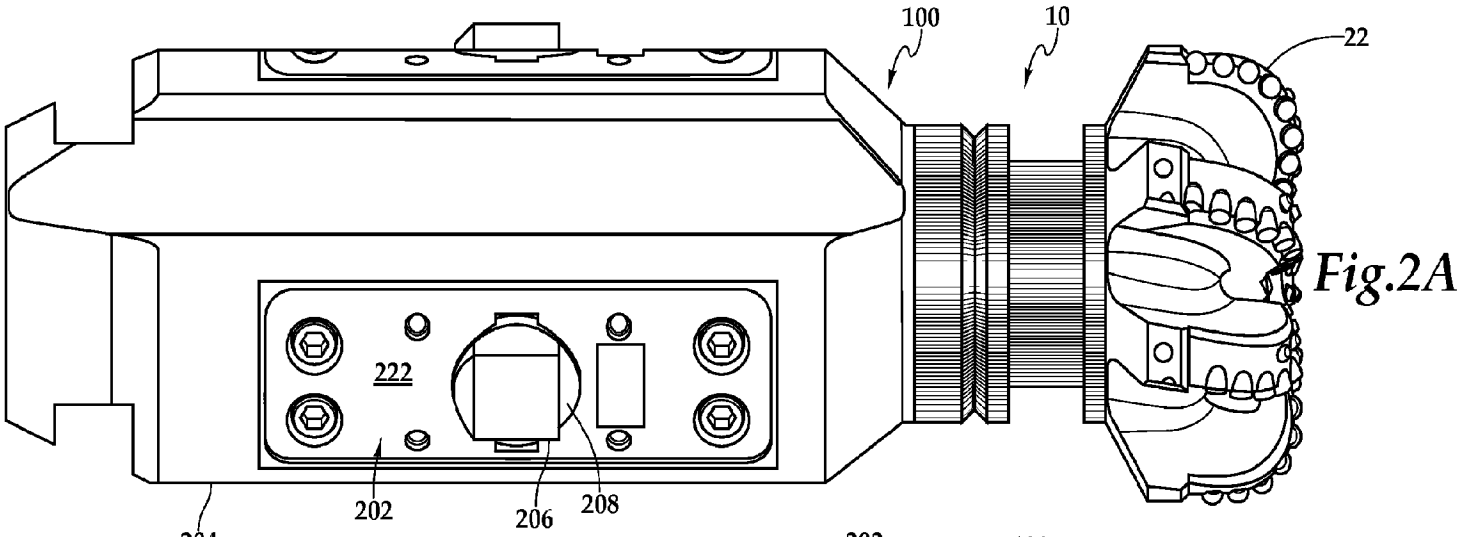
FIG. 2A is a side view of the lower end of the bottom hole assembly illustrating the near-bit reamer coupled to a drill bit.

FIG. 2A is a side view of the lower end of the bottom hole assembly 10 illustrating the NBR 100 and the drill bit 22. In this example, the NBR 100 and the drill bit 22 are directly adjacent on the bottom hole assembly 10. However, other arrangements where the NBR and drill bit are separated by one or more components are also within the scope of the present disclosure. As shown, the NBR 100 includes a plurality of cutting blocks 202 to engage to wall of the surrounding wellbore. The cutting blocks 202 are positioned circumferentially about an elongated body 204 of the NBR 100. In this example, the NBR 100 includes three cutting blocks 202 located at circumferential intervals of 120°. Of course, any suitable arrangement of cutting blocks may be used in various other embodiments and implementations without departing from the scope of the present disclosure.

Each of the cutting blocks 202 includes a cutter element 206 disposed on a radial piston 208 disposed inside the elongated body 204. The cutter elements are initially in a radially-retracted position. When the NBR 100 is actuated, the cutter elements 206 are moved radially outward relative to a central longitudinal axis 212 to contact the wellbore wall. As the NBR 100 is rotated, the cutter elements 206 abrade and cut away the formation, thereby expanding the diameter of the borehole.

Figure 2B:
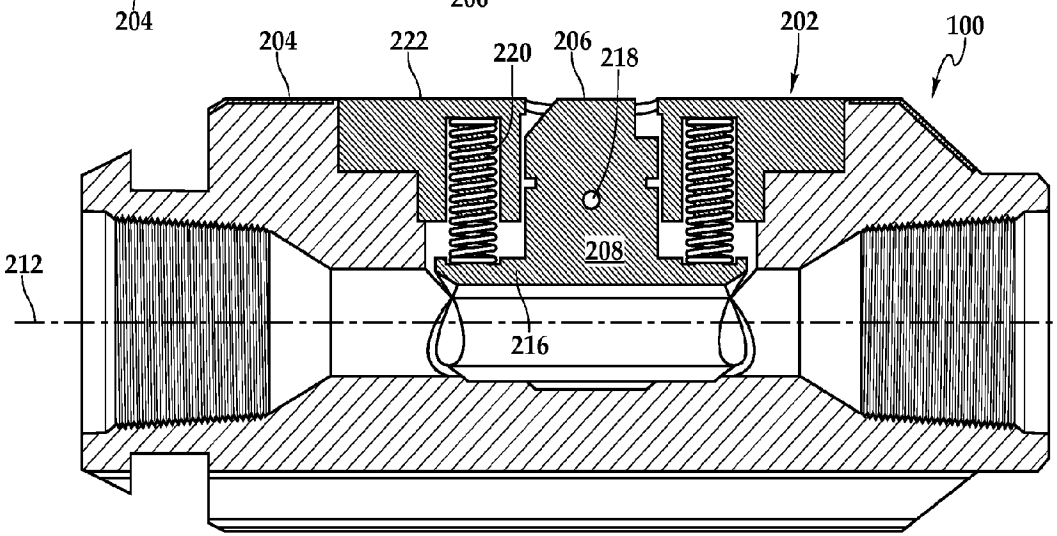
FIG. 2B is a cross-sectional side view of a portion of the near-bit reamer of FIG. 2A.

FIG. 2B is a cross-sectional side view of the NBR 100. As shown, each of the radial pistons 208 includes an anchor plate 216. The radial pistons 208 are held in place by shear pins 218 such that the cutter elements 206 are in the radially-retracted position. The cutter elements 206 are deployed by hydraulic pressure. That is, when the hydraulic pressure in the body 204 reaches a predetermined threshold, the pressure force acts on the anchor plates 216 to urge the radial pistons 208 radially outward with sufficient force to break the shear pins 218. Without the shear pins 218 to hold the radial pistons 208 in place, the radial pistons are moved by the hydraulic pressure of the drilling fluid outward toward the wall of the wellbore, deploying the cutter elements 206. The shear strength rating of the shear pins 218 determines the hydraulic pressure required to activate the NBR 100. In some examples, the shear pins 218 have shear strength rating of 120 bars, which corresponds to a hydraulic activation pressure for the NBR 100.

The NBR 100 further includes biasing members 220 (e.g., disk or coil springs) mounted between the anchor plates 216 of the radial pistons 208 and an outer flange 222 secured to the body 204. When the hydraulic pressure is reduced to a point where the pressure force against the anchor plates 216 is overcome by the biasing members 220 (e.g., when the flow of drilling fluid sufficiently decreases or ceases entirely), the radial pistons 208 are pulled back such that the cutter elements 206 are returned to the retracted position.

As described above, the NBR 100 is activated by increasing hydraulic pressure of the drilling fluid beyond a predetermined threshold determined by the shear strength rating of the shear pins 218. For example, in some implementations, the NBR may be activated by inserting one or more drop balls into a drilling fluid flow stream; pumping the drop balls in the drilling fluid down the drill string and into the bottom hole assembly; flowing the drilling fluid and drop balls through the NBR at a first hydraulic pressure; plugging one or more flow orifices (e.g., drill bit nozzles inlets or filter holes) thereby restricting flow of the drilling fluid upstream of the restriction and increasing the hydraulic pressure in the drilling fluid in the NBR upstream of the restriction to a predefined second hydraulic pressure. The increased hydraulic pressure acting on a surface of the NBR creates a shearing force on a shear pin which shears when it reaches a predetermined sheer force and allows the NBR to be activated with the predefined second hydraulic pressure of the drilling fluid flowing through the NBR.

Figures 3A, 3B, 3C:
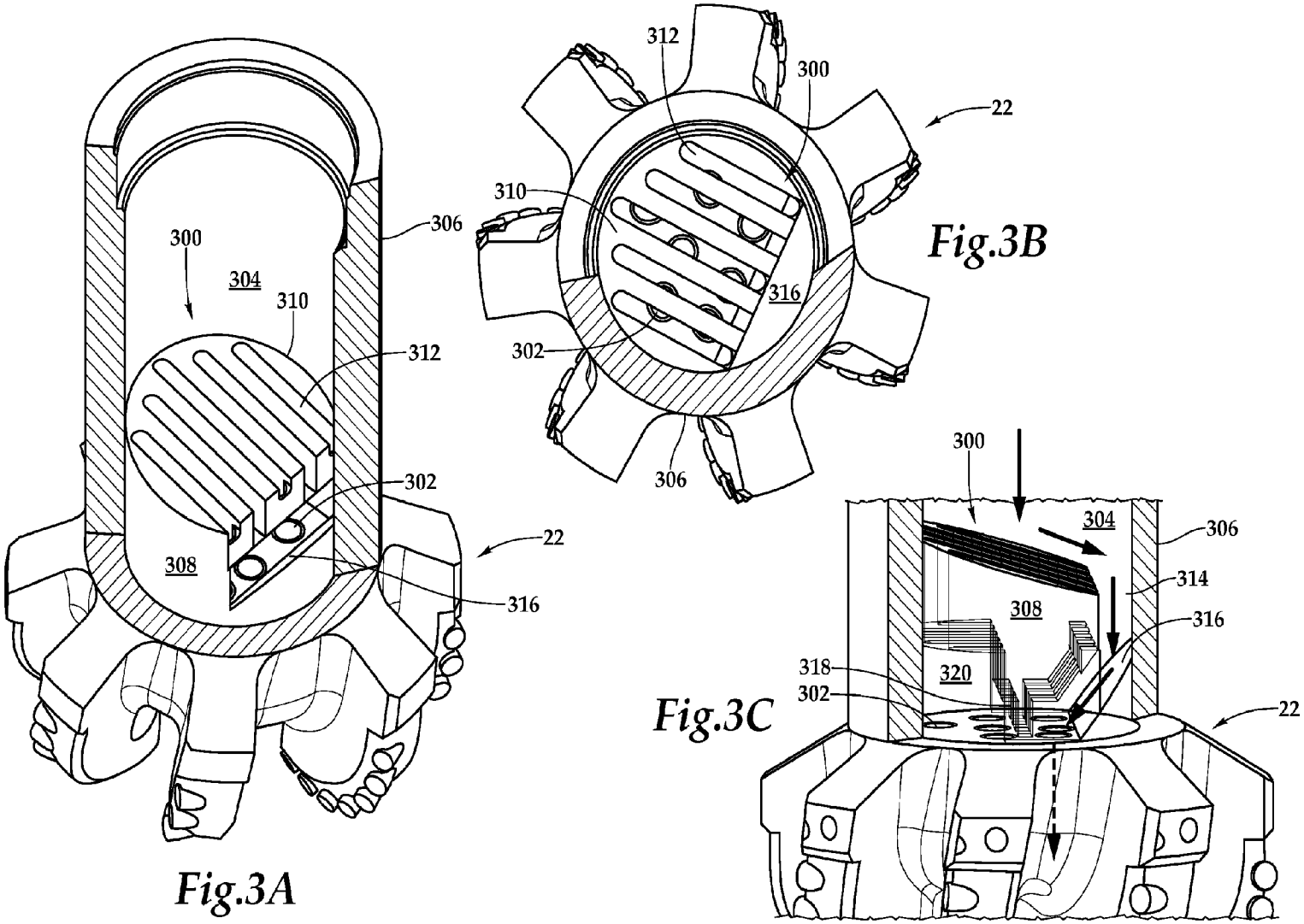
FIGS. 3A-3C are cross-sectional perspective, top, and side views of a drill bit fitted with a grate actuation assembly.

FIGS. 3A-3C are cross-sectional perspective, top, and side views of a drill bit 22 fitted with a grate actuation assembly 300 designed to facilitate a drop-ball technique for increasing hydraulic pressure to activate the NBR 100. In this example, the drill bit 22 is a fixed cutter directional drill bit with multiple (in this case, seven) nozzle inlets 302 for ejecting drilling fluid. However, the NBR-activation techniques discussed in the present disclosure are applicable to other suitable drill bits as well. As shown, the grate actuation assembly 300 is located in a central fluid passage 304 defined by the shank 306 of the drill bit 22. The grate actuation assembly 300 abuts the base of the central fluid passage 304 to cover the nozzle inlets 302.

The grate actuation assembly 300 includes a generally cylindrical body 308 having a sloped top surface 310 including a series of guide slots 312. The sloped surface 310 and the guide slots 312 are designed to direct one or more drop balls (not shown) towards an opening 314 proximal to the wall of the central fluid passage 304. As shown, the opening 314 provides access to the nozzle inlets 302 of the drill bit 22. The guide slots 312 are formed having a width less than the diameter of the drop balls. This configuration allows the drilling fluid to pass through the guide slots 312 to reach the nozzle inlets 302, while preventing the drop balls from passing through. A directional surface 316 leads the drop balls through the opening 314 and towards the nozzle inlets 302. Thus, in this example, the directional surface 316 slopes in a direction opposing the sloped top surface 310. Other suitable configurations and arrangements for leading the drop balls towards the drill bit nozzle inlets are also contemplated.

When the one or more drop balls encounter the nozzle inlets 302, the nozzle inlets become plugged—preventing the ejection of drilling fluid. Thus, plugging the nozzle inlets 302 restricts the flow of the drilling fluid through the bottom hole assembly 10. The flow restriction causes a hydraulic pressure increase in the drilling fluid up stream of the restriction. In this example, the grate actuation assembly 300 further includes a gate structure 318 partitioning the area of the central fluid passage 304 near the nozzle inlets 302, creating a protected area 320. The gate structure 318 prevents the drop balls from entering the protected area 320 and encountering the nozzle inlets 302 within. In summary, the grate actuation assembly 300 is designed to facilitate plugging at least some of the nozzles 302 in a first unprotected area of the bit but not the nozzle inlets 302 in the second protected area 320. The increased hydraulic pressure acting on the assembly creates a shearing force on a shear pin which shears when it reaches a predetermined shear force and allows the NBR to be activated with the predefined second hydraulic pressure of the drilling fluid flowing through the NBR.

This configuration allows the hydraulic pressure within the bottom hole assembly 10 to be increased by a sufficient amount to activate the NBR 100 without entirely preventing the ejection of drilling fluid from the bit. The magnitude of hydraulic pressure increase scales with the number of nozzle inlets 302 that are plugged by drop balls. Thus, the grate actuation assembly 300 can be designed to allow access by the one or more drop balls to a specific number of nozzle inlets 302, via positioning of the gate structure 318, in order to achieve a specific hydraulic pressure increase.

Figure 4A:
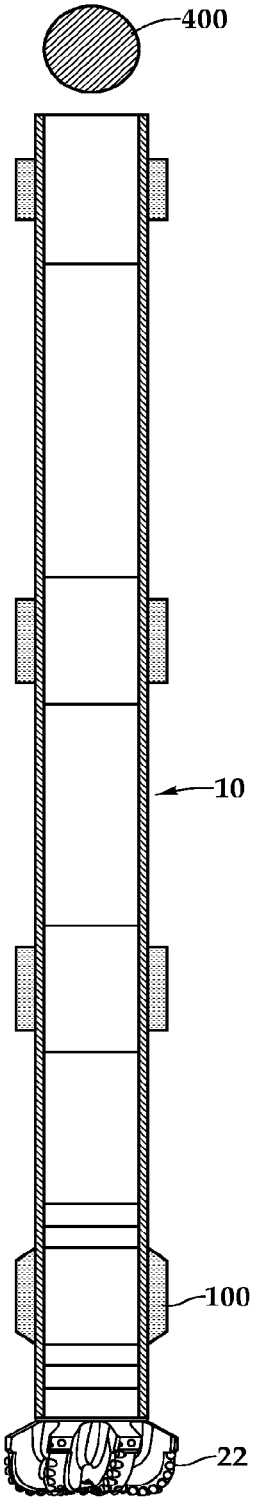
FIGS. 4A-4C are sequential diagrams of a technique for using deformable drop balls to activate a near-bit reamer.
Figure 4B:
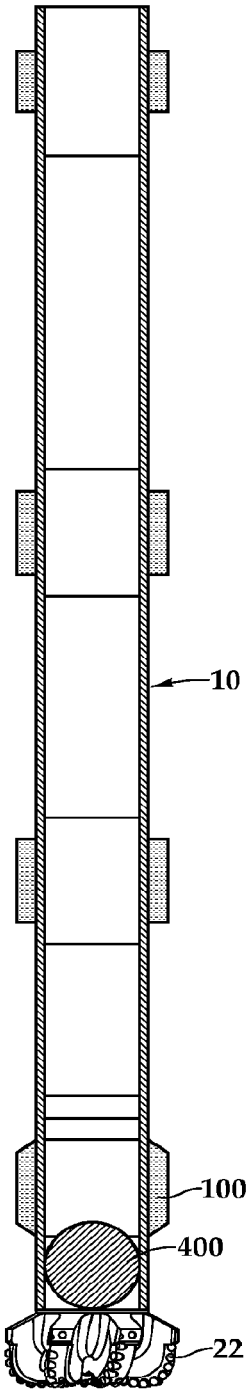
Figure 4C:
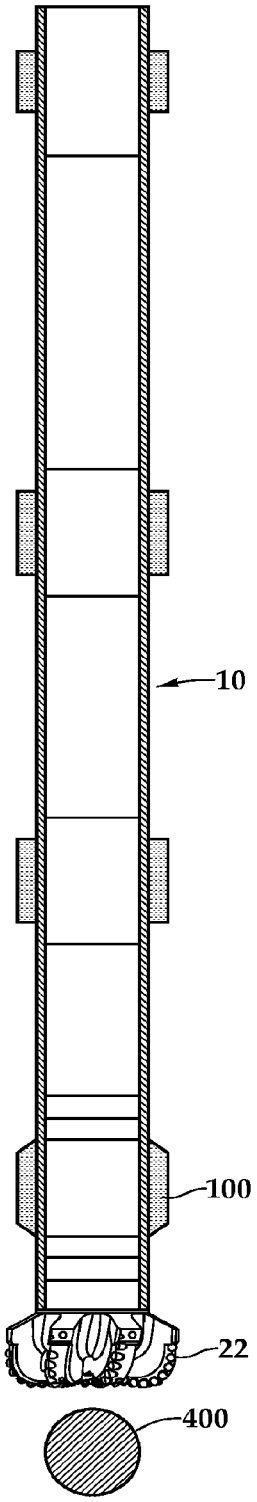

FIGS. 4A-4C are sequential diagrams of a technique for using deformable drop balls 400 to activate the NBR 100. The deformable drop balls are formed from a flexible material (e.g., a material including rubber, foam, and/or plastic). In this example, one or more deformable drop balls 400 are pumped through the bottom hole assembly 10 toward the nozzle inlets of the drill bit 22. The deformable drop balls 400 encounter and plug the nozzle inlets to increase the hydraulic pressure within the bottom hole assembly 10 to a level sufficient to activate the NBR 100. As the hydraulic pressure continues to increase within the bottom hole assembly 10, the deformable drop balls 400 are eventually forced through the nozzle openings. For example, the deformable drop balls 400 can be designed to shred under hydraulic pressure and pass through the nozzle openings in smaller pieces. As another example, the deformable drop balls 400 can be designed to deform and compress ("squeeze") through the nozzle openings under hydraulic pressure. In summary, the deformable drop balls 400 are designed to pass through the nozzle openings of the drill bit at a drilling fluid hydraulic pressure greater than what is required to activate the NBR 100.

Controlling the hydraulic pressure increase within the bottom hole assembly 10 can be achieved by altering various process parameters (e.g., the number of deformable drop balls, the size of the deformable drop balls, the material properties of the deformable drop balls, etc.). In one example, the deformable drop balls 400 are Halliburton's Foam Wiper Balls, which are made of natural rubber of open cell design. In this example, the deformable drop balls are used to plug the nozzle inlets of the drill bit, but other configurations and arrangements are also contemplated. For example, the deformable drop balls can be used to plug any orifice(s) downstream of the NBR 100.

Figure 5:
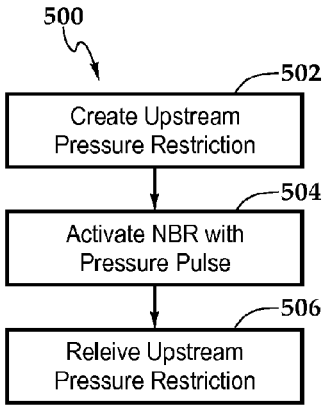
FIG. 5 is a flowchart illustrating a method of activating a near-bit reamer that involves creating a temporary flow restriction upstream of the near-bit reamer.

The above-described technique involving deformable drop balls is an exemplary technique for temporarily increasing hydraulic pressure in the bottom hole assembly for activation of the NBR. However, other suitable techniques for temporarily increasing the bottom-hole-assembly hydraulic pressure are also contemplated. For example, FIG. 5 is a flowchart illustrating a method 500 that involves temporarily creating an upstream flow restriction to generate a positive hydraulic pressure pulse sufficient to activate the NBR 100. At step 502, a flow restriction is created upstream of the NBR 100. The flow restriction can be created, for example, using an activation technique for operating a different downhole assembly tool. In one implementation, the conventional under reaming tool 14 is activated using a drop-ball technique that creates the temporary upstream flow restriction. In some other examples, an electronically activated valve is at least partially closed to create the temporary upstream flow restriction. At step 504, the hydraulic pressure pulse activates the NBR 100. At step 506, the upstream flow restriction is relieved to reestablish the flow of drilling fluid.

Figure 6:
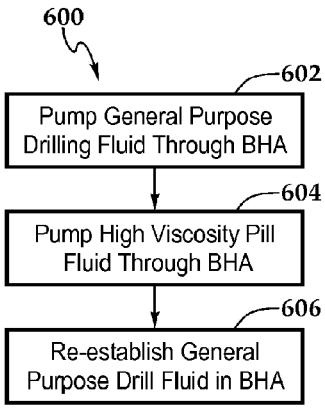
FIG. 6 is a flowchart illustrating a method of activating a near-bit reamer that involves introducing a highly viscous pill fluid to the bottom hole assembly.

FIG. 6 is a flowchart illustrating yet another method 600 for creating a temporary pressuring increase sufficient to activate the NBR 100. The method 600 involves a highly viscous pill fluid. At step 602, a general-purpose drilling fluid is pumped through the bottom hole assembly 10. At step 604, a high-viscosity pill fluid is pumped through the bottom hole assembly 10 in place of the general-purpose drilling fluid. Pumping the high-viscosity pill fluid creates a hydraulic pressure increase within the bottom hole assembly 10 that is sufficient to activate the NBR 100. At step 606, the pumping of the high-viscous pill fluid is ceased and the general-purpose drilling fluid is reestablished in the bottom hole assembly 10, restoring the original hydraulic pressure. In some examples, the pill fluid is a high-viscosity liquid (e.g., mud gunk, such as Halliburton's Geltone), such as used for well cleaning operations. In some examples, the pill fluid is a slurry-type fluid including liquid and small solid additives (e.g., Halliburton's fine Lubra-Beads or lost circulation material).

In some implementations, a filter actuation assembly positioned upstream of the drill-bit nozzles and downstream of the NBR is used in conjunction with drop balls to generate a sufficient hydraulic pressure increase for activating the NBR 100. The filter actuation assembly can include a filter head supported by one or more shear pins. The filter head includes an array of flow orifices designed with a small diameter for plugging by the drop balls. Plugging the flow orifices on the filter head creates a flow restriction that causes a hydraulic pressure increase. When then hydraulic pressure reaches a certain level (which is greater than the NBR-activation hydraulic pressure), the pressure force bearing on the filter head causes the shear pins to break. Without the supporting shear pins, the filter head moves to a new position in the bottom hole assembly and opens a new flow path for the drilling fluid to pass, which relieves the hydraulic pressure buildup.

Figure 7:
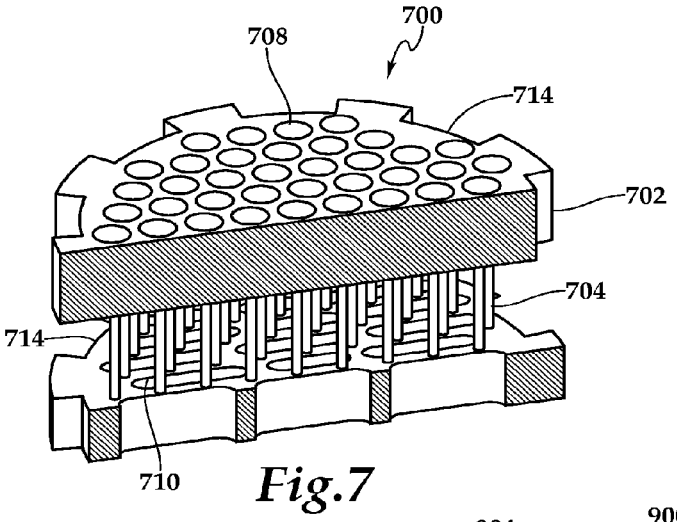
FIG. 7 is a cross-sectional perspective view of a first example filter actuation assembly.

FIG. 7 is a cross-sectional perspective view of a first example filter actuation assembly 700. The filter actuation assembly 700 includes a filter head 702, a set of axially oriented pillars 704 and a base plate 706. The filter head 702 is mounted on one or more secondary radial shear pins (see FIGS. 7A-7B). As shown, the filter head 702 defines an array of axial flow passages 708 aligned with the patterned flow openings 710 of the base plate 706. The diameter of the axial flow passages 708 is smaller than the diameter of the drop balls, so that drop balls encountering the filter head 702 effectively plug the flow passages.

Figure 7A:
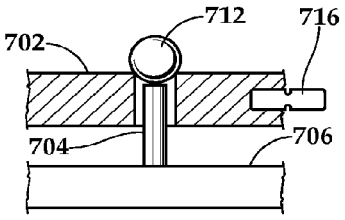
FIGS. 7A-7B are sequential diagrams illustrating operation of the first example filter actuation assembly.
Figure 7B:
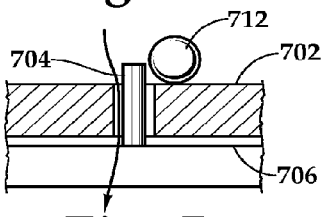

When the filter actuation assembly is free of any drop balls, the axial flow passages 708 and flow openings 710 allow drilling fluid to pass through the filter actuation assembly 700. With the flow passages 708 being plugged by drop balls 712, as shown in FIG. 7A, the flow of drilling fluid is restricted to the ancillary flow passages 714 at the radial edge of the filter head 702 and base plate 706 (see FIG. 7). The hydraulic pressure buildup eventually causes the shear pin 716 to break, allowing the filter head 702 to slide downward to rest against the base plate 706. As the filter head 702 translates toward the base plate 706, the pillars 704 project through the axial flow passages 708 to displace the drop balls 712 (See FIG. 7B).

Figure 8A:
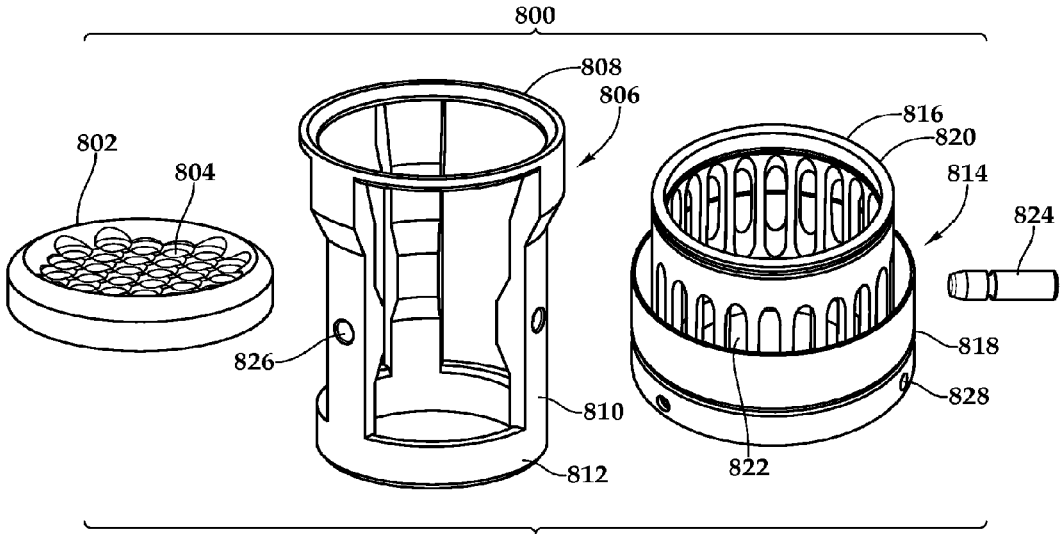
FIG. 8A is an exploded diagram illustrating a second example of a filter actuation assembly.
Figure 8B:
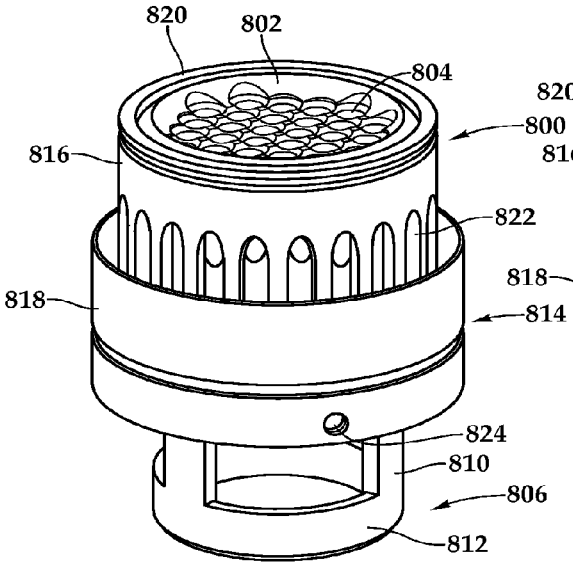
FIGS. 8B and 8C are perspective and cross-sectional side views of the second example filter actuation assembly in an assembled form.
Figure 8C:
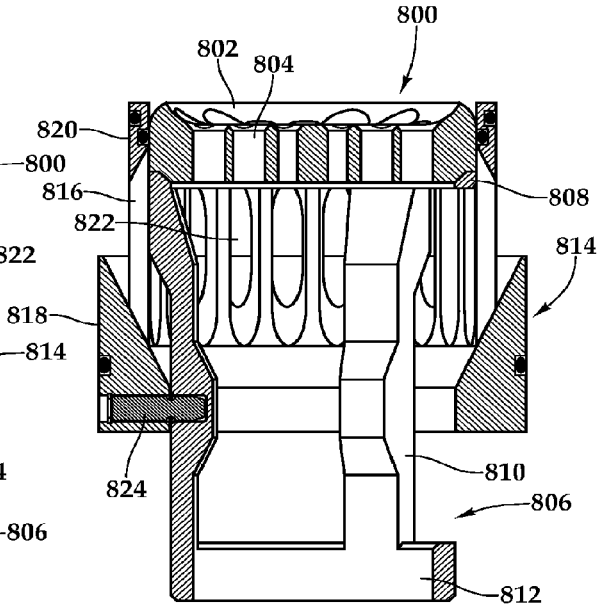

FIG. 8A is an exploded diagram illustrating a second example filter actuation assembly 800. FIGS. 8B and 8C are perspective and cross-sectional side views of the filter actuation assembly 800 in an assembled form. As shown, the filter actuation assembly 800 includes a disc-shaped filter head 802 defining an array of axial flow passages 804. The filter head 802 is supported in a hollow cylindrical rack 806. The rack 806 includes an annular seat 808 for receiving the filter head 802, three axially extending legs 810 that support the seat, and an annular base 812.

A cylindrical sleeve 814 fits concentrically around the rack 806. The sleeve 814 includes an inner sheath 816 and an outer sheath 818. The inner sheath 816 defines an annular lip 820 that seals against the filter head 802 to prevent drilling fluid from leaking between the two filter-assembly components. The cylindrical side wall of the inner sheath 816 defines a plurality of axial slots 822. As shown in FIGS. 8B and 8C, the sleeve 814 is held in place against the rack 806 by secondary shear pins 824 traversing radial openings 826 in the legs 810 of the rack and radial openings 828 in the outer sheath 818.

Figure 8F:
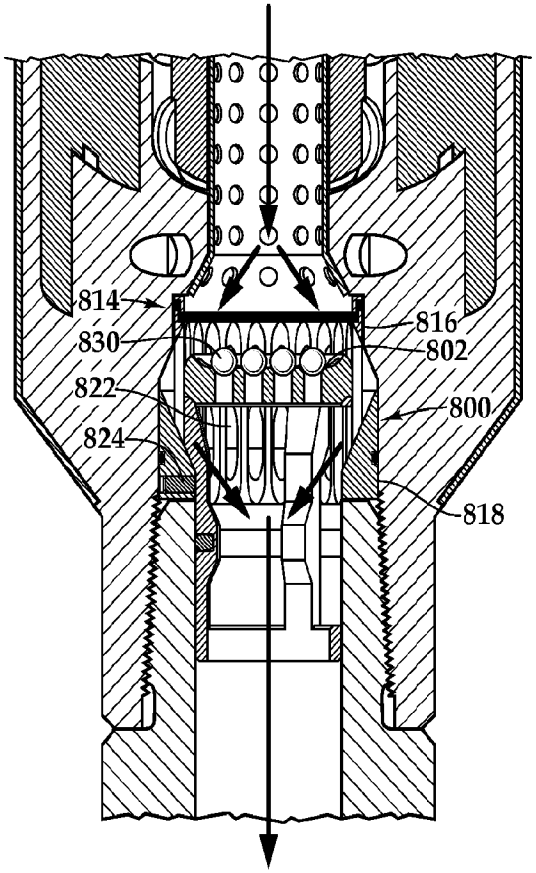
FIGS. 8D-8F are sequential diagrams illustrating operation of the second example filter actuation assembly.
Figure 8E:
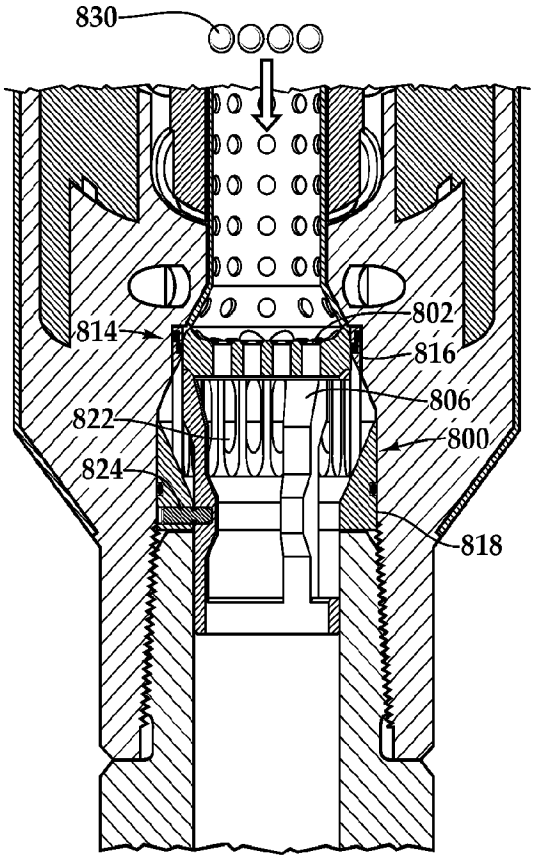
Figure 8D:
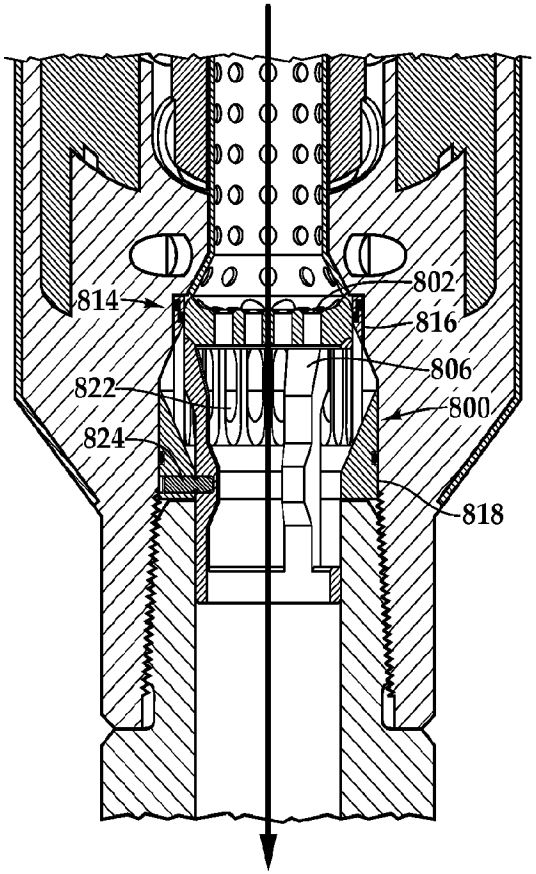

FIGS. 8D-8F are sequential diagrams illustrating operation of the filter actuation assembly 800. As shown in FIG. 8D, when the flow passages 804 (see FIGS. 8A to 8C) of the filter head 802 are clear of any drop balls, drilling fluid flows downstream unimpeded through the filter head and the rack 806. In FIG. 8E, when the drop balls 830 encounter the filter head 802, the flow passages 804 (see FIGS. 8A to 8C) become plugged, restricting the flow of drilling fluid through the bottom hole assembly 10 to build sufficient hydraulic pressure for activation of the NBR 100. As the hydraulic pressure continues to build, the pressure acting on the filter head 802 and rack 806 create as force until the shear pins 824 are severed upon reaching a predetermined shear force. In FIG. 8F, when the shear pins 824 break, the filter head 802 and rack 806 slide downward relative to the stationary sleeve 814. When the filter head 802 and rack 806 are in the lowered position, the axial slots 822 in the side wall of the inner sheath 816 are exposed, which provides a new flow path for the drilling fluid to pass through the bottom hole assembly 10.

Figure 9:
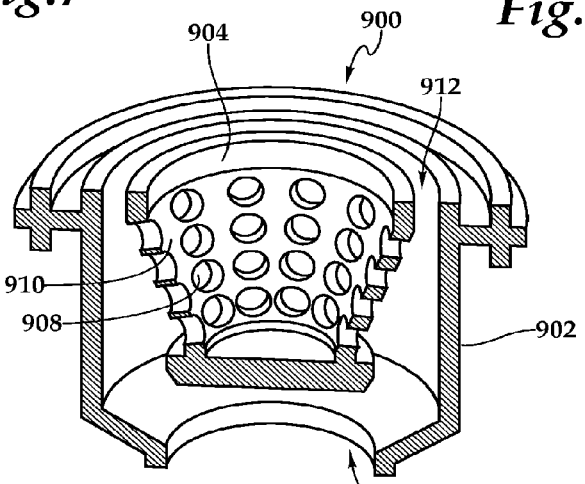
FIG. 9 is a cross-sectional perspective view of a third example of a filter actuation assembly.

FIG. 9 is a cross-sectional perspective view of a third example filter actuation assembly 900. In this example, the filter actuation assembly 900 includes a support member 902 mounted to the an interior wall of the bottom hole assembly 10, a filter head 904 coupled to the support member, and an axial flow orifice 906. The filter head 904 includes an array of radial flow openings 908 distributed along a frustoconical sidewall 910. Before introduction of the drop balls, drilling fluid flows freely through the filter head 904, passing through the radial flow openings 908 and the axial flow orifice 906. When the drop balls encounter and plug the radial flow openings 908, flow through the filter head 904 is severely inhibited, if not entirely prevented. Thus, the drilling fluid flow is restricted to an ancillary flow path formed by a gap 912 between the filter head 904 and the support member 902. The restriction of fluid flow achieved by plugging the filter head 904 creates a hydraulic pressure increase sufficient to activate the NBR 100.

Figure 10B:
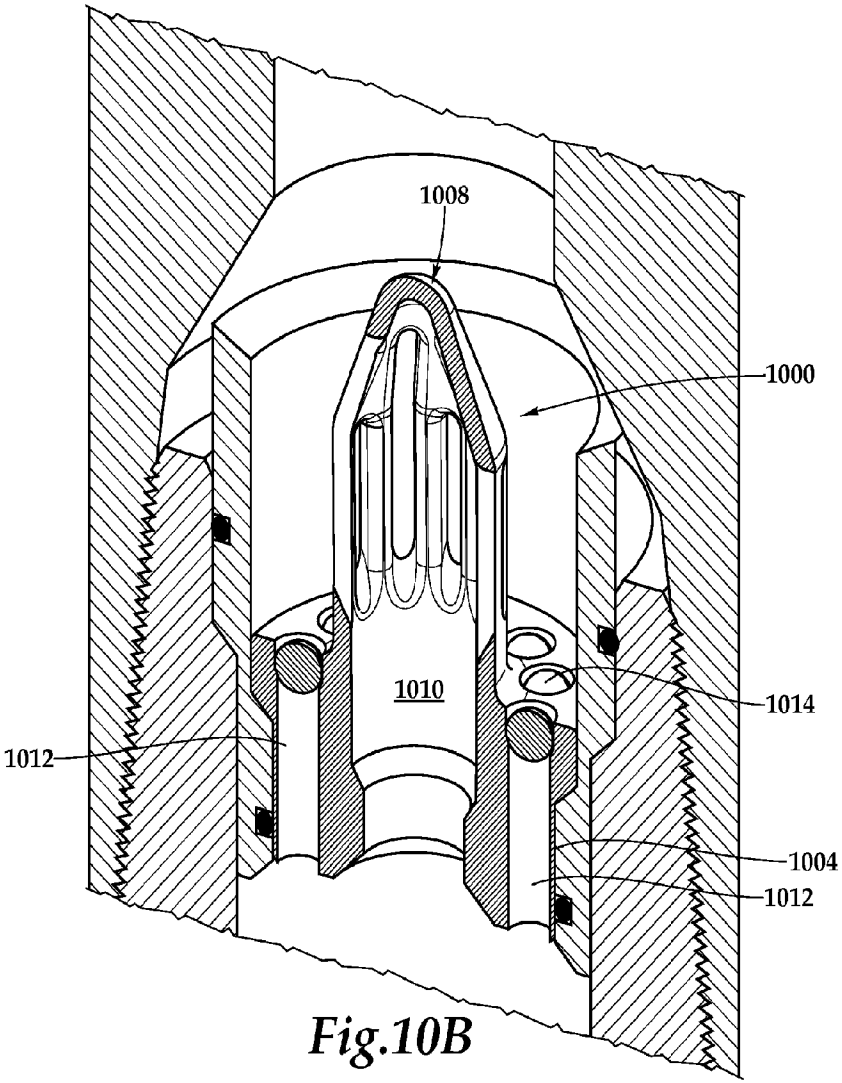
FIG. 10B is a cross-sectional perspective view of the activation bushing of FIG. 10A.
Figure 10A:
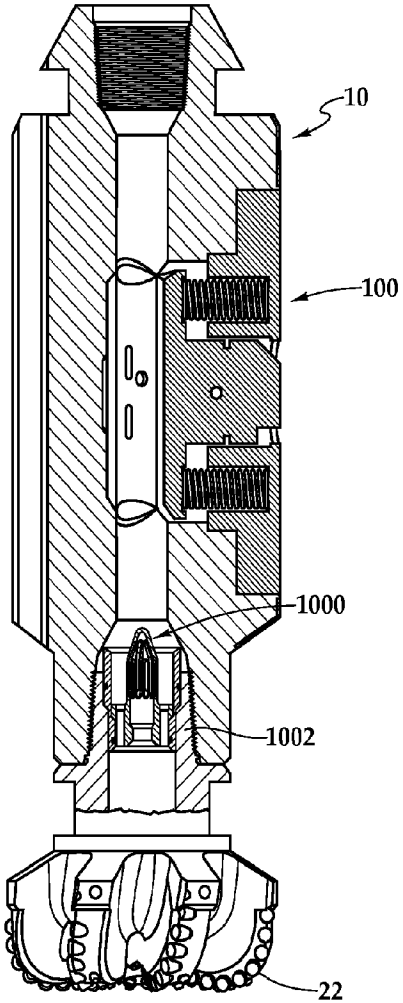
FIG. 10A is a cross-sectional side view of a lower section of a bottom hole assembly featuring an activation bushing.

FIG. 10A is a cross-sectional side view of a lower section of the bottom hole assembly 10 featuring an activation bushing 1000. FIG. 10B is a cross-sectional perspective view of the activation bushing 1000. In this example, the activation bushing is installed at the interface between the shank 1002 of the drill bit 22 and the central bore of the NBR 100. However, it is appreciated that the activation busing 1000 could be located at any position within the bottom hole assembly 10 downstream of the NBR 100. The activation bushing 1000 includes a flanged cylindrical base 1004 mounted and sealed against the wall of the central fluid passage 1006 in the drill bit 22. A slotted inlet structure 1008 aligns with a main flow passage 1010 extending through the base 1004 of the activation bushing 1000. Multiple ancillary flow passages 1012 are spaced circumferentially around the cylindrical base 1004. As shown, the slotted inlet structure 1008 is provided with a sloped, conical tip that prevents drop balls from plugging the main flow passage 1010. The ancillary flow passages 1012 on the other hand are oriented axially and designed to be plugged by the drop balls.

Figure 10D:
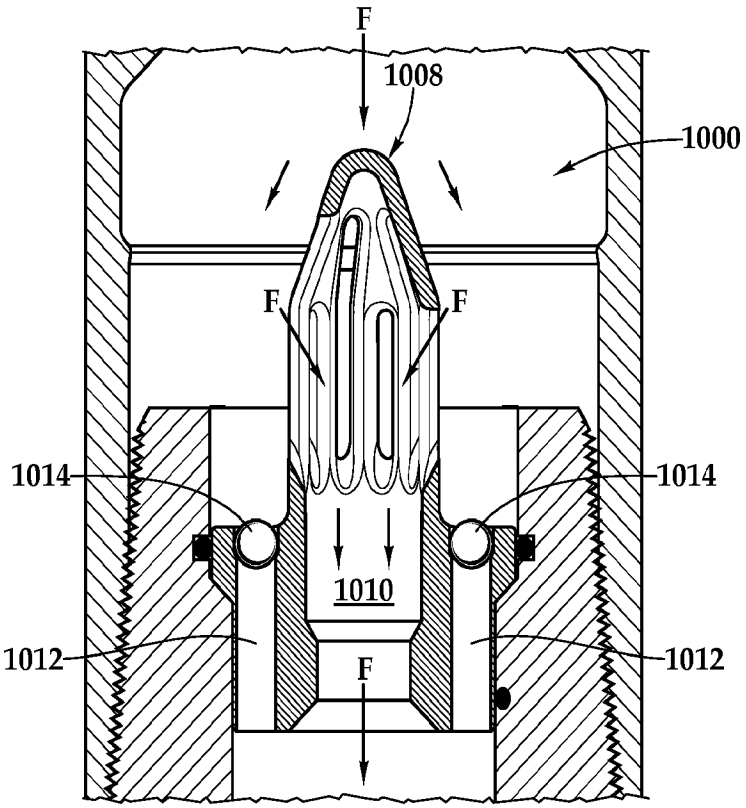
FIGS. 10C and 10D are sequential diagrams illustrating operation of the activation bushing of FIGS. 10A and 10B.
Figure 10C:
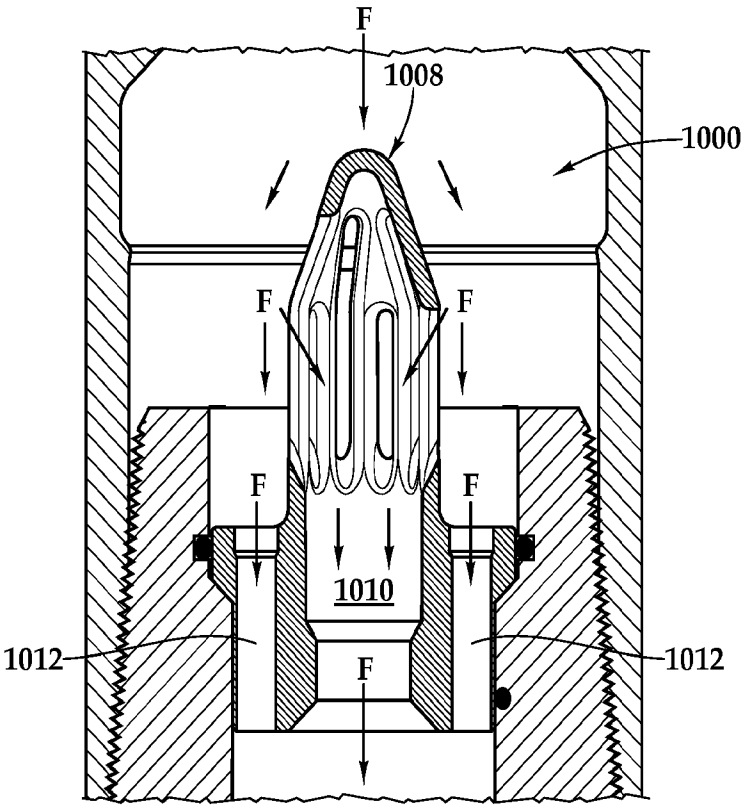

FIGS. 10C and 10D are sequential diagrams illustrating operation of the activation bushing 1000. As shown in FIG. 10C, when the ancillary flow passages 1012 are clear of any drop balls, drilling fluid flows unimpeded through the ancillary flow passages and the main flow passage 1010. In FIG. 10D, when the ancillary flow passages 1012 have been plugged by the drop balls 1014, the flow of drilling fluid is confined to the main flow passage 1010. The reduction in flow area achieved by plugging at least some of the ancillary flow passages 1012 creates a hydraulic pressure increase in the drilling fluid sufficient to activate the NBR 100.

The use of terminology such as "above," and "below" throughout the specification and claims is for describing the relative positions of various components of the system and other elements described herein. Similarly, the use of any horizontal or vertical terms to describe elements is for describing relative orientations of the various components of the system and other elements described herein. Unless otherwise stated explicitly, the use of such terminology does not imply a particular position or orientation of the system or any other components relative to the direction of the Earth gravitational force, or the Earth ground surface, or other particular position or orientation that the system other elements may be placed in during operation, manufacturing, and transportation.

A number of embodiments of the invention have been described. Nevertheless, it will be understood that various modifications may be made without departing from the spirit and scope of the invention.

What is claimed is:

1. A method of hydraulically activating a near-bit reamer, said method comprising:

providing a near-bit reamer including a grate assembly including a sloped top surface with a series of guide slots and an opening;

positioning the near-bit reamer upstream of one or more drill bit nozzle inlets of a drill bit positioned in a bottom hole assembly, said opening of the grate assembly providing access to the drill bit nozzle inlets, and said opening being located proximal to a wall of a central fluid passage in the drill bit:

lowering the bottom hole assembly into a wellbore;

holding cutter elements of the near-bit-reamer in an unactivated position using at least one shear pin;

inserting one or more drop balls into a drilling fluid;

flowing the drilling fluid and the drop balls to the grate assembly upstream of the one or more drill bit nozzle inlets;

guiding the drop balls through the opening towards the drill bit nozzle inlets with the grate assembly;

at least partially plugging one or more of the drill bit nozzle inlets with the drop balls thereby restricting fluid flow and correspondingly increasing hydraulic pressure of the drilling fluid;

creating a force on the at least one shear pin responsive to the hydraulic pressure, to shear the at least one shear pin, thereby moving the cutter elements to an activated radially-outward position.

2. The method of claim 1, wherein guiding the drop balls towards the drill bit nozzle inlets comprises:

permitting the drop balls to contact one or more of the drill bit nozzle inlets located in a first area of the drill bit; and preventing, with a gate structure, the drop balls from contacting one or more of the drill bit nozzle inlets located in a second area of the drill bit.

3. A hydraulically activated near-bit reamer, positionable above a drill bit in a bottom hole assembly disposable in a wellbore, said near-bit reamer comprising:

at least one shear pin holding at least one moveable element of the near-bit reamer in an unactivated position;

at least one cutter element connected to the moveable element, said cutter element positionable in a radially retracted position when the moveable element is in the unactivated position and positionable in a radially-outward position when the moveable element is in an activated position;

and a flow restrictor located upstream of the drill bit in the bottom hole assembly, the flow restrictor including at least one opening being located proximal to a wall of a central fluid passage in the drill bit, said opening being configured to allow passage of at least one drop ball carried in drilling fluid flowing through the near-bit reamer to at least one drill bit nozzle inlet and said at least one drill bit nozzle inlet sized to become plugged by the at least one drop ball and thereby to facilitate a flow restriction in said at least one drill bit nozzle sufficient to increase hydraulic pressure upstream of the flow restriction and create a shearing force on the at least one shear pin responsive to the hydraulic pressure thereby shearing the shear pin and allowing the moveable element to move from the unactivated position to the activated position; and wherein the flow restrictor comprises a grate assembly, the grate assembly including: a sloped top surface including a plurality of guide slots configured to guide the at least one drop ball through the opening and towards the at least one drill bit nozzle inlet.

4. The near-bit reamer of claim 3, wherein the grate assembly further comprises a gate structure configured to permit one or more of the drop balls to contact drill bit nozzle inlets in a first area and prevent the drop balls from contacting drill bit nozzle inlets in a second area.

* * * * *